US010544719B2

(12) United States Patent
Kawai et al.

(10) Patent No.: US 10,544,719 B2
(45) Date of Patent: Jan. 28, 2020

(54) INTERNAL COMBUSTION ENGINE

(71) Applicant: AISIN SEIKI KABUSHIKI KAISHA, Kariya-shi, Aichi-ken (JP)

(72) Inventors: Yoshiyuki Kawai, Nagoya (JP); Yoichi Oyamada, Kariya (JP); Yoshiyuki Suzuki, Anjo (JP); Akihiro Yamashita, Kariya (JP)

(73) Assignee: AISIN SEIKI KABUSHIKI KAISHA, Kariya-Shi, Aichi-Ken (JP)

( * ) Notice: Subject to any disclaimer, the term of this patent is extended or adjusted under 35 U.S.C. 154(b) by 72 days.

(21) Appl. No.: 15/886,472

(22) Filed: Feb. 1, 2018

(65) Prior Publication Data

US 2018/0223708 A1 Aug. 9, 2018

(30) Foreign Application Priority Data

Feb. 6, 2017 (JP) ..... 2017-019320

(51) Int. Cl.

| | |
|---|---|
| ***F01M 13/04*** | (2006.01) |
| ***F02D 21/08*** | (2006.01) |
| ***F01M 13/00*** | (2006.01) |
| ***F02M 26/00*** | (2016.01) |

(52) U.S. Cl.

CPC ..... *F01M 13/04* (2013.01); *F01M 13/0033* (2013.01); *F02D 21/08* (2013.01); *F01M 2013/0038* (2013.01); *F02M 2026/001* (2016.02)

(58) Field of Classification Search

CPC ..... F01M 13/04; F01M 13/0033; F01M 2013/005; F01M 2013/0038; F02D 21/08; F02M 2026/001

See application file for complete search history.

(56) References Cited

U.S. PATENT DOCUMENTS

| | | | | |
|---|---|---|---|---|
| 5,957,118 | A * | 9/1999 | Tateno | F01M 13/04 123/573 |
| 2010/0077999 | A1* | 4/2010 | Okada | F01M 13/022 123/572 |
| 2015/0114368 | A1* | 4/2015 | Kurita | F01M 13/04 123/573 |

FOREIGN PATENT DOCUMENTS

| | | | |
|---|---|---|---|
| JP | 2-188612 A | | 7/1990 |
| JP | H02188612 A | * | 7/1990 |
| JP | 2003-013722 A | | 1/2003 |

* cited by examiner

*Primary Examiner* — Jacob M Amick

*Assistant Examiner* — Charles Brauch

(74) *Attorney, Agent, or Firm* — Buchanan Ingersoll & Rooney PC

(57) ABSTRACT

An internal combustion engine includes: a cylinder having a combustion chamber formed at an upper side thereof and accommodating a piston to be reciprocally movable; a crankcase provided below the cylinder and accommodates a crankshaft; and a blow-by gas passageway recirculating blow-by gas, which leaks into the crankcase from the combustion chamber, to the combustion chamber through an intake system, in which an inner surface portion of the crankcase is provided with a blow-by gas intake part, and the blow-by gas intake part includes a protruding portion protruding in a direction in which the crankshaft extends, and the intake port opened in the protruding direction is formed at a tip end portion of the protruding portion.

18 Claims, 5 Drawing Sheets

INTERNAL COMBUSTION ENGINE

CROSS REFERENCE TO RELATED APPLICATIONS

This application is based on and claims priority under 35 U.S.C. § 119 to Japanese Patent Application 2017-019320, filed on Feb. 6, 2017, the entire contents of which are incorporated herein by reference.

TECHNICAL FIELD

This disclosure relates to an internal combustion engine, and particularly, to an internal combustion engine which recirculates blow-by gas, which leaks into a crankcase, to an intake system.

BACKGROUND DISCUSSION

In the related art, there has been known an internal combustion engine which recirculates blow-by gas, which leaks into a crankcase of the internal combustion engine, to an engine intake system (intake system) (e.g., see JP 02-188612 A (Reference 1)).

The internal combustion engine disclosed in Reference 1 has a cylinder block in which cylinders are disposed, a cylinder head which is fixed to an upper end portion of the cylinder block, and an oil pan which is fixed to a lower end portion of the cylinder block. In addition, the cylinder block includes a crankcase disposed below a crankshaft.

Here, in the internal combustion engine disclosed in Reference 1, blow-by gas produced in the cylinders by combustion of fuel does not flow to an exhaust manifold but leaks into the crankcase and accumulates in the crankcase. For this reason, the internal combustion engine disclosed in Reference 1 is provided with a blow-by gas passageway that recirculates the blow-by gas accumulated in the crankcase to the engine intake system. The blow-by gas passageway has an opening formed in an inner surface portion of the crankcase, and includes a first blow-by gas passageway (intake passageway) in which the blow-by gas flows. Further, the opening formed in the inner surface portion of the crankcase is opened in a direction orthogonal to a direction in which the crankshaft extends.

However, since the opening of the blow-by gas passageway formed in the inner surface portion of the crankcase of the internal combustion engine disclosed in Reference 1 is opened in the direction orthogonal to the direction in which the crankshaft extends, oil, which is scattered in the crankcase by the rotation of the crankshaft, is attached to the opening of the blow-by gas passageway such that the oil is likely to be drawn into a first blow-by gas passageway. In this case, the oil drawn into the first blow-by gas passageway flows into combustion chambers from the engine intake system, and as a result, a problem occurs with respect to combustion in the combustion chambers. For this reason, there is a demand for an internal combustion engine capable of inhibiting the oil from penetrating into the blow-by gas passageway.

Thus, a need exists for an internal combustion engine which is not susceptible to the drawback mentioned above.

SUMMARY

An internal combustion engine according to an aspect of this disclosure includes: a cylinder that has a combustion chamber formed at an upper side thereof and accommodates a piston to be reciprocally movable; a crankcase that is provided below the cylinder and accommodates a crankshaft; and a blow-by gas passageway that recirculates blow-by gas, which leaks into the crankcase from the combustion chamber, to the combustion chamber through an intake system, in which an inner surface portion of the crankcase is provided with a blow-by gas intake part that includes an intake port into which the blow-by gas is introduced from the crankcase and an intake passageway which allows the intake port and the blow-by gas passageway to communicate with each other, and the blow-by gas intake part includes a protruding portion that protrudes in a direction in which the crankshaft extends, and the intake port opened in the protruding direction is formed at a tip end portion of the protruding portion.

An internal combustion engine according to another aspect of this disclosure includes: a cylinder that has a combustion chamber formed at an upper side thereof and accommodates a piston to be reciprocally movable; a crankcase that is provided below the cylinder and accommodates a crankshaft; and a blow-by gas passageway that recirculates blow-by gas, which leaks into the crankcase from the combustion chamber, to the combustion chamber through an intake system, in which an inner surface portion of the crankcase is provided with a blow-by gas intake part that includes an intake port into which the blow-by gas is introduced from the crankcase and an intake passageway which allows the intake port and the blow-by gas passageway to communicate with each other, the blow-by gas intake part includes a protruding portion (53, 253, 353, 453, 553, 753) that protrudes in a direction in which the crankshaft extends, and the intake port opened in the protruding direction is formed at a tip end portion of the protruding portion, and the blow-by gas intake part has a plurality of protruding portions which protrude in both directions in the direction in which the crankshaft extends, and each of the plurality of protruding portions has an intake port formed at a tip end portion thereof.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Hereinafter, embodiments disclosed here will be described with reference to the drawings.

First Embodiment

First, the configuration of an engine 1 (internal combustion engine) according to a first embodiment disclosed here will be described with reference to FIGS. 1 to 3. Here, in the following description, a direction in which a crankshaft 16 extends is defined as an X direction, and a direction in a horizontal plane which is orthogonal to the X direction is defined as a Y direction. In addition, a vertical direction orthogonal to the X direction and the Y direction is defined as a Z direction.

Figure 1:
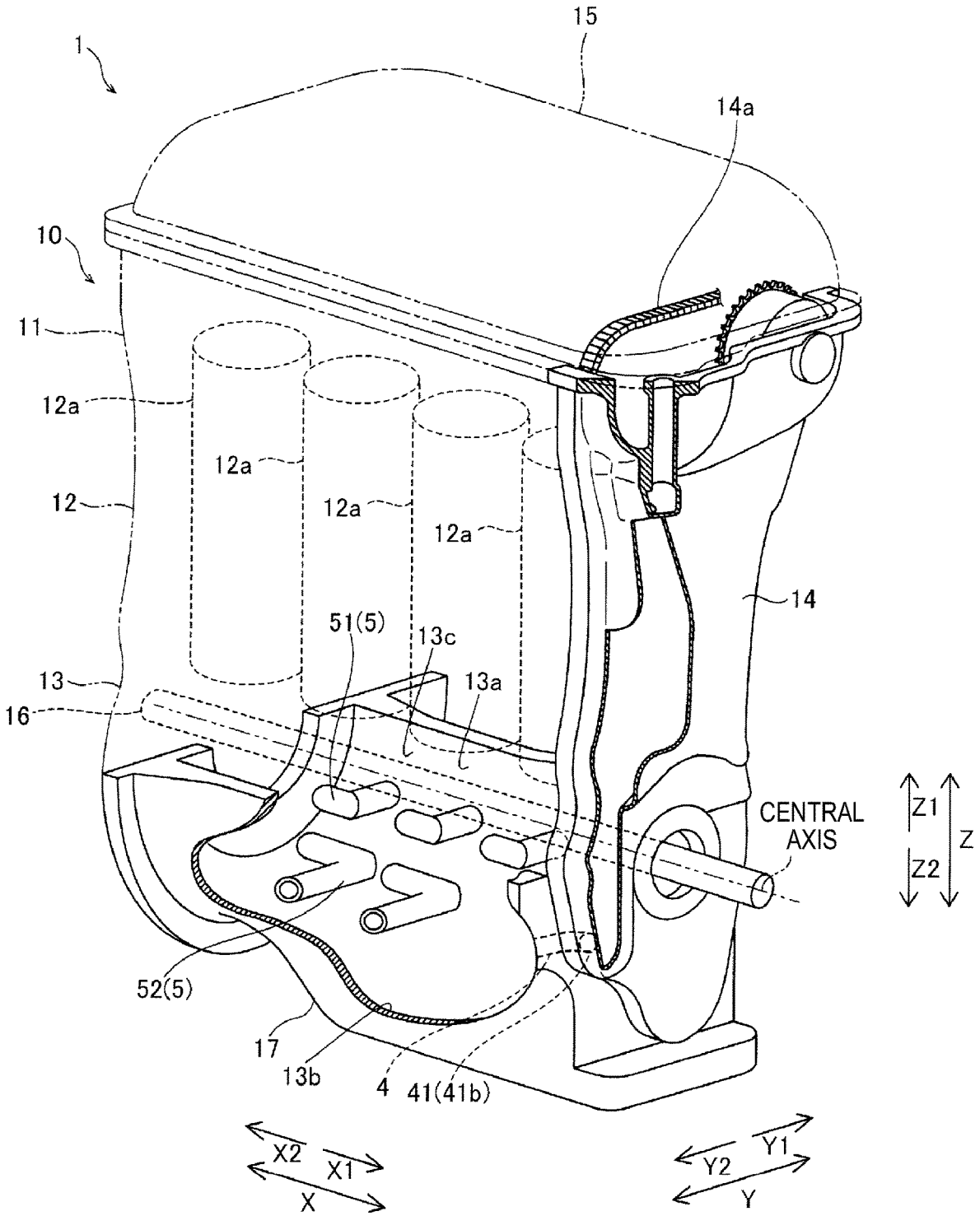
FIG. 1 is a perspective view illustrating a schematic configuration of an engine according to a first embodiment disclosed here.

As illustrated in FIG. 1, the engine 1 according to a first embodiment disclosed here is provided with an engine main body 10 including a cylinder head 11, a cylinder block 12, and a crankcase 13. Multiple (four) cylinders 12*a*, which are arranged in a line in a predetermined direction (X direction), are disposed in the cylinder block 12. The cylinder head 11 is fixed to the upper end portion (the end portion at a Z1 side) of the cylinder block 12. The crankcase 13 is fixed to the lower end portion (end portion at a Z2 side) of the cylinder block 12. A crankshaft 16 is accommodated in the crankcase 13. A timing chain cover 14 (hereinafter, referred to as a TCC 14), which covers a timing chain 14*a*, is mounted at a lateral portion (lateral portion at an X1 side) at one side of the engine main body 10. A head cover 15 is mounted on an upper end portion of the cylinder head 11.

Figure 2:
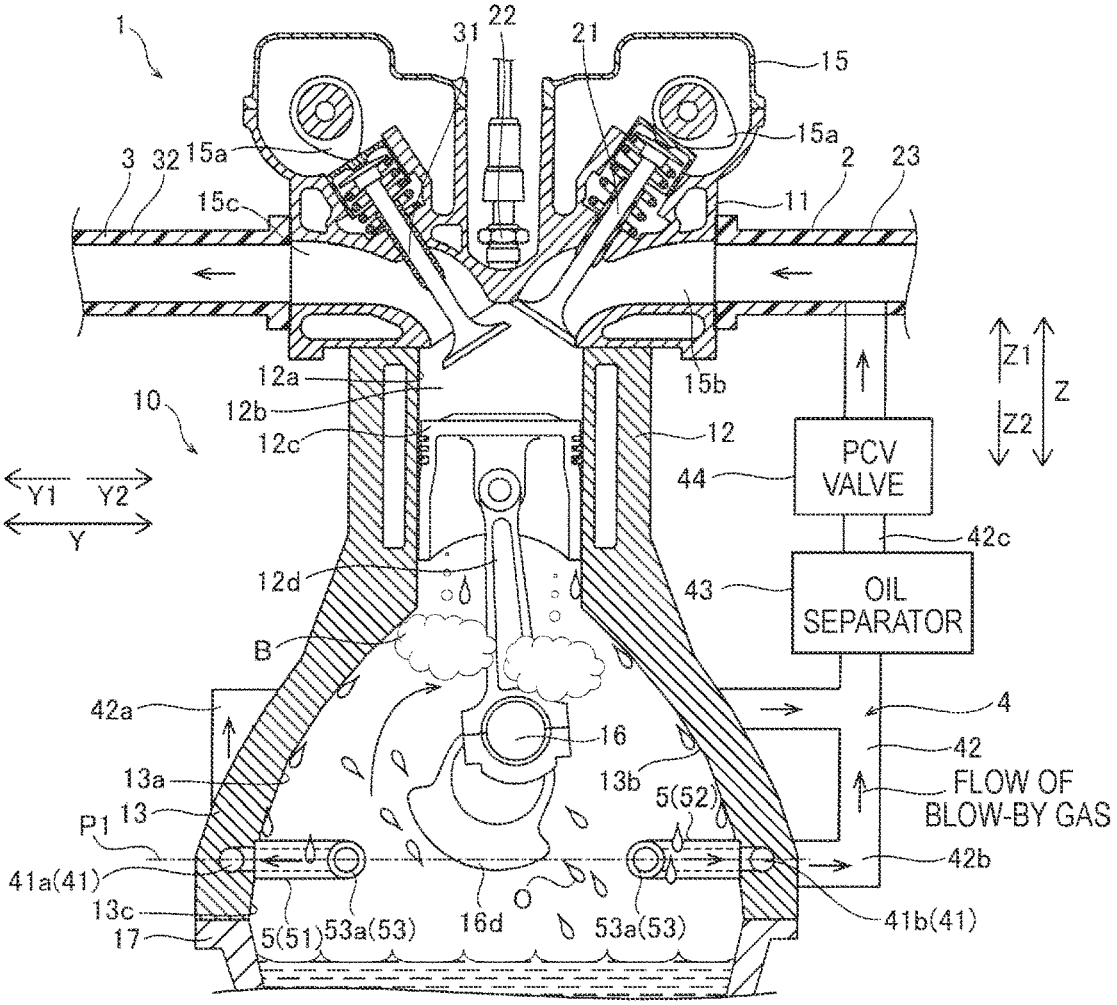
FIG. 2 is a cross-sectional view illustrating a schematic configuration of the engine according to the first embodiment disclosed here.

As illustrated in FIG. 2, the cylinder head 11 is provided with an intake device 2 (intake system) which introduces air into the multiple cylinders 12*a*, and an exhaust system 3 which discharges exhaust gas from the multiple cylinders 12*a*. An ignition plug 22 and intake and exhaust valves 21 and 31 are embedded in the cylinder head 11 in which the intake and exhaust valves 21 and 31 are periodically opened and closed by the rotation of camshafts 15*a*. In addition, the cylinder head 11 has a combustion chamber 12*b*, an intake port 15*b* through which intake air is sent to the combustion chamber 12*b*, and an exhaust port 15*c* through which burnt gas is discharged. The intake port 15*b* is connected to an intake manifold 23 of the intake device 2. The exhaust port 15*c* is connected to an exhaust manifold 32 of the exhaust system 3.

As illustrated in FIG. 2, the combustion chamber 12*b* is formed at the upper side in the cylinder 12*a* and configured to combust air and fuel introduced from the intake port 15*b* by the ignition plug 22. A piston 12*c* is provided in each of the multiple cylinders 12*a* in which the piston 12*c* is accommodated to be reciprocally movable and the connecting rod 12*d* connects the piston 12*c* and the crankshaft 16 to each other.

Figure 3:
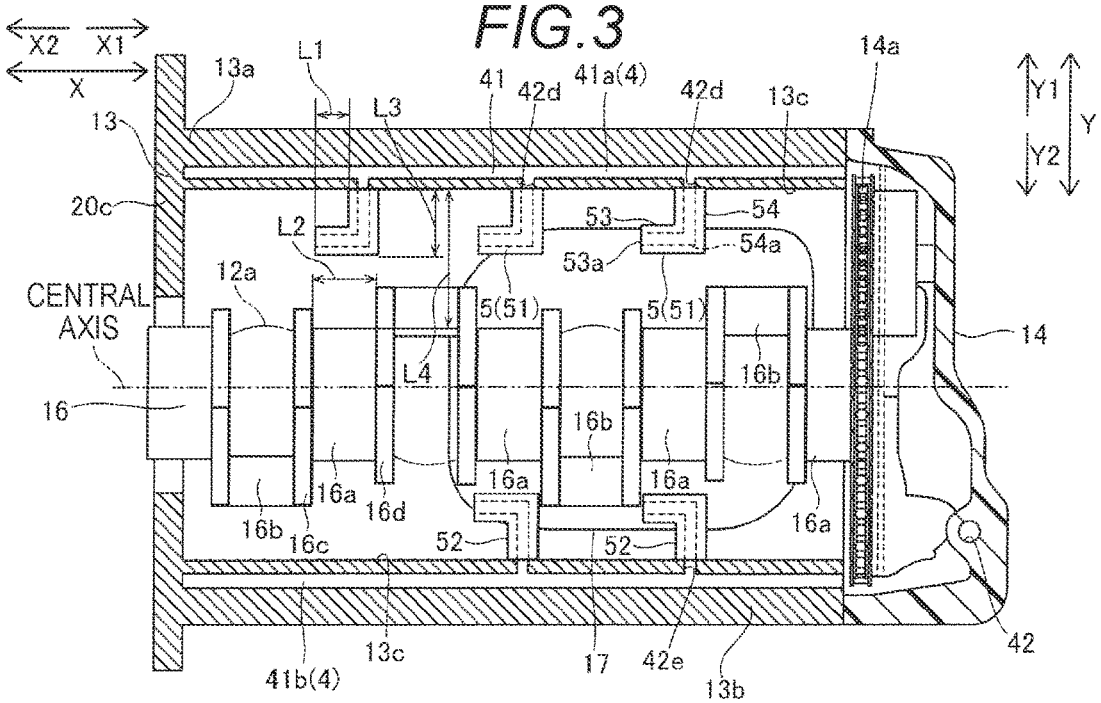
FIG. 3 is a cross-sectional view illustrating an interior of a crankcase of the engine according to the first embodiment disclosed here.

As illustrated in FIG. 3, the crankshaft 16 has multiple crank journals 16*a* which are disposed on the central axis of the crankshaft 16, and multiple crankpins 16*b* which are disposed on an eccentric axis that deviates from the central axis of the crankshaft 16. In addition, the crankshaft 16 has crank arms 16*c* each which connects one of the multiple crank journals 16*a* and one of the multiple crankpins 16*b* to each other, and counter weights 16*d* which are provided integrally with the crank arms 16*c*, respectively.

As illustrated in FIG. 2, an oil pan 17 is provided at the lower side of the crankcase 13 so as to store engine oil (hereinafter, referred to as "oil O"). The oil O is pumped toward the upper side in the engine 1 from the oil pan 17 by an oil pump (not illustrated) so as to lubricate respective parts, and then the oil O is dropped by its own weight and returns back to the oil pan 17.

As illustrated in FIG. 2, the engine 1 is configured to guide blow-by gas B, which leaks into the crankcase 13 from the combustion chamber 12*b* through a gap between the piston 12*c* and the cylinder 12*a*, to the combustion chamber 12*b* through the intake device 2. Specifically, the engine 1 is provided with a blow-by gas passageway 4 so as to recirculate the blow-by gas B, which leaks into the crankcase 13 from the combustion chamber 12*b*, to the combustion chamber 12*b* through the intake device 2. Here, the blow-by gas B is drawn into the blow-by gas passageway 4 by negative pressure generated in the cylinder 12*a* in accordance with the movement of the piston 12*c*. The blow-by gas passageway 4 has a crank inside passageway 41 which is formed in the crankcase 13, and a connecting passageway 42 which connects the crank inside passageway 41 and the intake manifold 23 to each other.

As illustrated in FIG. 3, the crank inside passageway 41 has a first passageway 41*a* formed in a first sidewall 13*a* of the crankcase 13 at one side (Y1 side) in a direction (Y direction) orthogonal to the direction (X direction) in which the crankshaft 16 extends. In addition, the crank inside passageway 41 has a second passageway 41*b* formed in a second sidewall 13*b* of the crankcase 13 at the other side (Y2 side) in the direction (Y direction) orthogonal to the direction (X direction) in which the crankshaft 16 extends.

As illustrated in FIG. 3, the connecting passageway 42 is formed in the TCC 14. As illustrated in FIG. 2, the connecting passageway 42 has a third passageway 42*a* which is connected to the first passageway 41*a*, a fourth passageway 42*b* which is connected to the second passageway 41*b*, and a junction 42*c* into which the third passageway 42*a* and the fourth passageway 42*b* merge. Here, the downstream end of the junction 42*c* is connected to the intake manifold 23. An oil separator 43 and a PCV valve 44 are disposed in the junction 42*c* in which the oil separator 43 separates oil mist contained in the blow-by gas B flowing in from the crank inside passageway 41, and the PCV valve 44 adjusts the amount of blow-by gas B flowing into the intake manifold 23. As described above, the blow-by gas B leaking into the crankcase 13 flows in the order of the crank inside passageway 41, the connecting passageway 42, and the intake manifold 23, and flows into the combustion chamber 12*b* so that the blow-by gas B is combusted again in the combustion chamber 12*b*.

<Blow-by Gas Intake Part>

In the engine 1, the oil separator 43 disposed in the blow-by gas passageway 4 is a member that captures oil mist which is contained in the blow-by gas B and has a small particle diameter. For this reason, with respect to the oil O having a large particle diameter, the oil separator 43 allows a part of the captured oil O to pass therethrough because the amount of oil exceeds the amount of oil that can be captured. The oil O passing through the oil separator 43 flows into the intake manifold 23, and the oil O is combusted together with air and fuel in the combustion chamber 12*b*. Defective combustion occurs when the oil O is mixed during the combustion in the combustion chamber 12*b*. Therefore, the engine 1 according to the first embodiment has blow-by gas intake parts 5 such that the oil O scattered by the rotation of the crankshaft 16 or the like is hardly drawn into the blow-by gas passageway 4 into which the blow-by gas B flows. Hereinafter, the blow-by gas intake part 5 will be described.

The blow-by gas intake parts 5 are configured to take the blow-by gas B in the crankcase 13 into the blow-by gas passageway 4 such that the blow-by gas B flows into the blow-by gas passageway 4. As illustrated in FIG. 1, the multiple (five) blow-by gas intake parts 5 are integrally provided on an inner surface portion 13*c* of the crankcase 13. The multiple (three) blow-by gas intake parts 5 are disposed on the first sidewall 13*a*. In addition, the multiple (two) blow-by gas intake parts 5 are disposed on the second sidewall 13*b*. Here, among the multiple blow-by gas intake parts 5, the multiple blow-by gas intake parts 5 disposed on the first sidewall 13*a* will be referred to as first blow-by gas intake parts 51. In addition, among the multiple blow-by gas intake parts 5, the multiple blow-by gas intake parts 5 disposed on the second sidewall 13*b* will be referred to as second blow-by gas intake parts 52.

As illustrated in FIG. 3, the blow-by gas passageway 4 has multiple (three) first communication passageways 42*d* which allow respective first blow-by gas intake parts 51 to communicate with the first passageway 41*a*. In addition, the blow-by gas passageway 4 has multiple (two) second communication passageways 42*e* which allow respective second blow-by gas intake parts 52 to communicate with the second passageway 41*b*. Hereinafter, a blow-by gas intake part 5 will be described with reference to the blow-by gas intake part 5 which is disposed closest to the TCC 14 side (X1 side) in the first blow-by gas intake part 51 among the multiple blow-by gas intake parts 5, as an example. All of the first blow-by gas intake parts 51 disposed on the first sidewall 13*a* have the same configuration. In addition, the second blow-by gas intake parts 52 disposed on the second sidewall 13*b* are mirror-image symmetrical to the first blow-by gas intake parts 51 with respect to a symmetric plane extending in the X direction.

As illustrated in FIG. 3, the blow-by gas intake part 5 has a protruding portion 53 that protrudes in the direction (X direction) in which the crankshaft 16 extends. The protruding portion 53 protrudes in a direction (X2 direction) opposite to the TCC 14 side in the direction (X direction) in which the crankshaft 16 extends. In addition, the blow-by gas intake part 5 has a connecting portion 54 that connects the protruding portion 53 and the inner surface portion 13*c* of the crankcase 13 to each other. The connecting portion 54 connects the inner surface portion 13*c* of the crankcase 13 and an end portion of the protruding portion 53 at the TCC 14 side (X1 side) in the direction (X direction) in which the crankshaft 16 extends. In addition, the connecting portion 54 protrudes toward the crankshaft 16 at one side (Y2 side) in the direction orthogonal to the direction in which the crankshaft 16 extends.

As illustrated in FIG. 3, the blow-by gas intake part 5 has an intake port 53*a* which takes the blow-by gas B from the interior of the crankcase 13, and an intake passageway 54*a* which allows the intake port 53*a* and the blow-by gas passageway 4 to communicate with each other. Here, the intake passageway 54*a* and the first passageway 41*a* are connected to each other by the first communication passageway 42*d*. The intake port 53*a* and the intake passageway 54*a* have approximately the same inner diameter as the blow-by gas passageway 4.

As illustrated in FIG. 3, the intake passageway 54*a* connects the first communication passageway 42*d* and the intake port 53*a* to each other. Specifically, the intake passageway 54*a* extends from the upstream end of the first communication passageway 42*d* to one side (Y2 side) in the direction orthogonal to the direction in which the crankshaft 16 extends, and extends to one side (X2 side) in the direction in which the crankshaft 16 extends. The intake port 53*a* is formed at the tip end portion of the protruding portion 53 and opened in the direction in which the protruding portion 53 protrudes. That is, the intake port 53*a* is opened along one side (X2 side) in the direction in which the crankshaft 16 extends. In this case, the intake port 53*a* is opened at a side opposite to the TCC 14 side in the direction in which the crankshaft 16 extends.

As illustrated in FIG. 3, the blow-by gas intake part 5 is configured not to interfere with the crankshaft 16. Specifically, the blow-by gas intake part 5 is disposed at a position facing the crank journal 16*a*. Further, the length L1 of the protruding portion 53 in the X direction is smaller than the length L2 of the crank journal 16*a* of the crankshaft 16 in the X direction. Therefore, the interference between the blow-by gas intake part 5, which protrudes toward the crankshaft 16, and the counter weight 16*d* and the crank arm 16*c*, which are disposed at positions eccentric to the crank journal 16*a* of the crankshaft 16 is avoided. In addition, the length L3 of the connecting portion 54 in the Y direction is smaller than the length L4 of the interval between the first sidewall 13*a* and the crank journal 16*a*. In addition, as illustrated in FIG. 2, the blow-by gas intake part 5 is disposed at a position P1 at a lower side (Z2 side) from the crank journal 16*a*. Therefore, the interference between the blow-by gas intake part 5 and the crank journal 16*a* of the crankshaft 16 is avoided.

Effect of First Embodiment

The following effects may be obtained in the first embodiment.

In the first embodiment, as described above, the blow-by gas intake parts 5 are provided on the inner surface portion 13*c* of the crankcase 13 in order to allow the blow-by gas B to flow into the blow-by gas passageway 4. In addition, the blow-by gas intake part 5 includes the protruding portion 53 which protrudes in the direction (X direction) in which the crankshaft 16 extends, and has the intake port 53*a* that is formed at the tip end portion of the protruding portion 53 and opened in the direction in which the protruding portion 53 protrudes. Therefore, it is possible to make the oil O, which is scattered, by the rotation of the crankshaft 16, in the direction (Y direction) orthogonal to the direction (X direction) in which the crankshaft 16 extends, hardly attached to the periphery of the intake port 53*a* formed at the tip end portion of the protruding portion 53. As a result, since the oil O is hardly introduced into the intake passageway 54*a* from the intake port 53*a*, it is possible to inhibit the oil O from penetrating into the blow-by gas passageway 4.

In the first embodiment, the protruding portion 53 is disposed between the cylinders 12*a*. That is, the protruding portions 53 are disposed between the multiple cylinders 12*a*, respectively. Therefore, since the protruding portions 53 are disposed between the cylinders 12*a*, the protruding portions 53 are disposed at the positions facing the crank journals 16*a* of the crankshaft 16. Here, the crankpins 16*b* are disposed at the positions eccentric to the rotation axis of the crank journals 16*a*, and the crankpins 16*b* are configured to rotate in the vicinity of the inner surface portion 13*c* of the crankcase 13. As a result, since the protruding portions 53 are disposed at the positions facing the crank journals 16*a*, the oil O scattered from the crankpins 16*b* is hardly caught by the protruding portions 53, and as a result, it is possible to further inhibit the oil O from penetrating into the blow-by gas passageway 4.

Second Embodiment

Next, a second embodiment will be described with reference to FIGS. 4 to 6. In the second embodiment, an example in which a protruding portion 253 has an oil penetration inhibiting portion 255 unlike the first embodiment will be described. In addition, in the drawings, constituent elements identical to the constituent elements in the first embodiment are denoted by the same reference numerals as the constituent elements in the first embodiment, and detailed descriptions thereof will be omitted.

Figure 4:
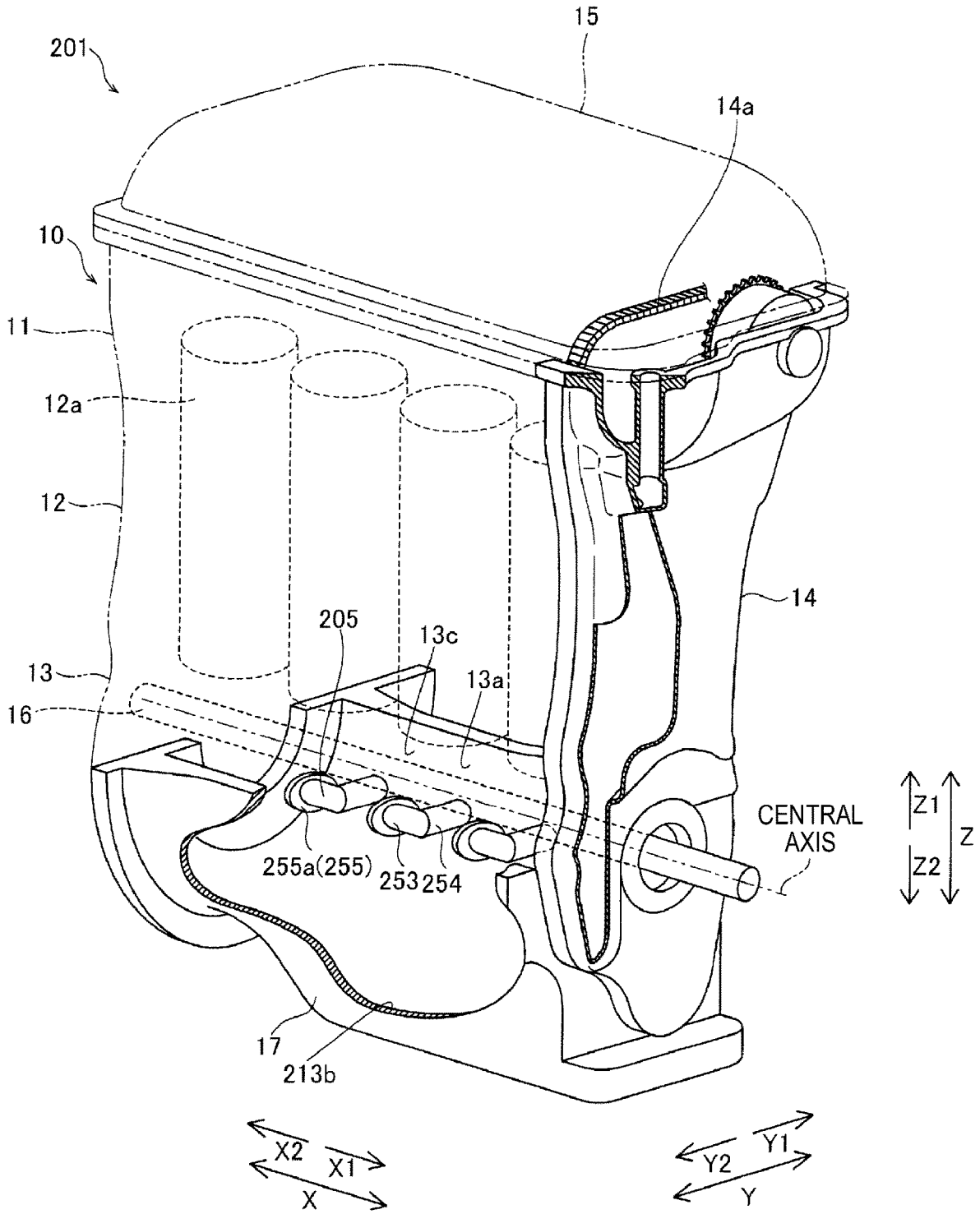
FIG. 4 is a perspective view illustrating a schematic configuration of an engine according to a second embodiment disclosed here.
Figure 5:
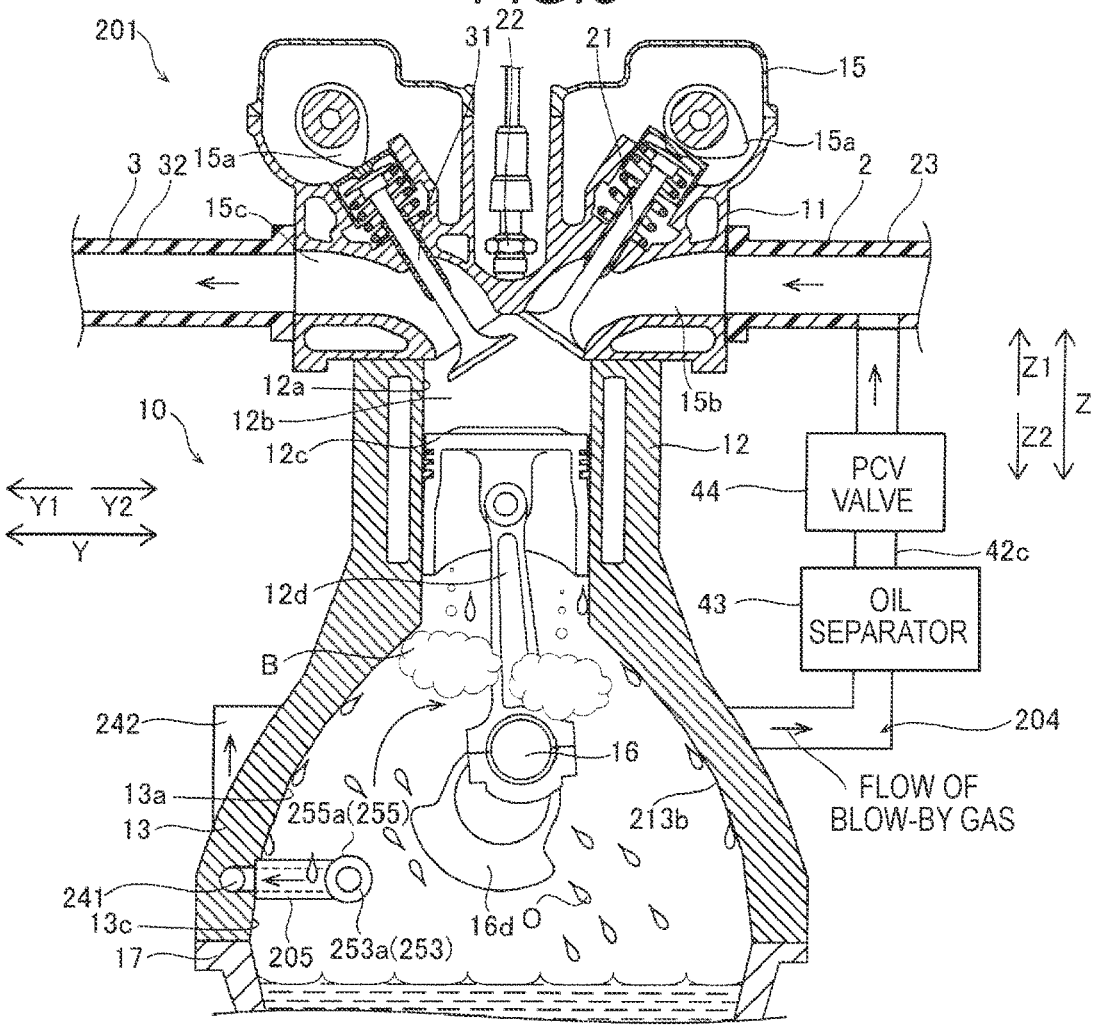
FIG. 5 is a cross-sectional view illustrating a schematic configuration of the engine according to the second embodiment disclosed here.

As illustrated in FIG. 4, an engine 201 has multiple blow-by gas intake parts 205 each having the oil penetration inhibiting portion 255. Here, as illustrated in FIG. 5, a blow-by gas passageway 204, which connects each blow-by intake part 205 to the intake device 2, has a crank inside passageway 241 which is formed in the crankcase 13, and a connecting passageway 242 which connects the crank inside passageway 241 and the intake manifold 23. The crank inside passageway 241 is formed in the first sidewall 13*a* of the crankcase 13 at one side (Y1 side) in the direction orthogonal to the direction in which the crankshaft 16 extends. The crank inside passageway 241 is not formed in the second sidewall 213*b* of the crankcase 13 at the other side (Y2 side) in the direction orthogonal to the direction in which the crankshaft 16 extends.

<Blow-by Gas Intake Part>

As illustrated in FIG. 4, the multiple (three) blow-by gas intake parts 205 are integrally provided on the inner surface portion 13*c* of the crankcase 13. The multiple blow-by gas intake parts 205 are disposed in the first sidewall 13*a*. As illustrated in FIG. 6, the blow-by gas passageway 204 has multiple (three) first communication passageways 42*d* that allow respective multiple blow-by gas intake parts 205 to communicate with the crank inside passageway 241. Hereinafter, a blow-by gas intake part 205 will be described with reference to the blow-by gas intake part 205 which is disposed at a side (X1 side) closest to the TCC 14 among the multiple blow-by gas intake parts 205, as an example of the blow-by gas intake part 205. Further, all of the multiple blow-by gas intake parts 205 have the same configuration.

Figure 6:
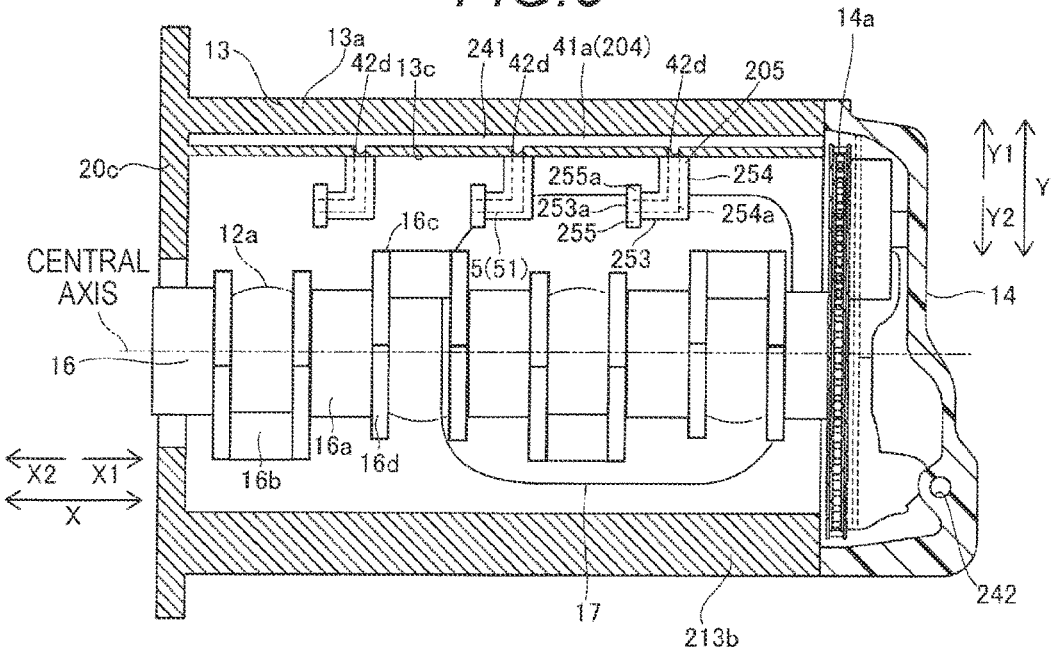
FIG. 6 is a cross-sectional view illustrating an interior of a crankcase of the engine according to the second embodiment disclosed here.

As illustrated in FIG. 6, the blow-by gas intake part 205 has a protruding portion 253 that protrudes in the direction (X direction) in which the crankshaft 16 extends. The protruding portion 253 protrudes in a direction (X2 direction) opposite to the TCC 14 side in the direction (X direction) in which the crankshaft 16 extends. In addition, the blow-by gas intake part 205 has a connecting portion 254 that connects the protruding portion 253 and the inner surface portion 13*c* of the crankcase 13 to each other. The connecting portion 254 connects the inner surface portion 13*c* of the crankcase 13 and an end portion of the protruding portion 253 at the TCC 14 side (X1 side) in the direction (X direction) in which the crankshaft 16 extends. In addition, the connecting portion 254 protrudes at one side (Y2 side) in the direction orthogonal to the direction in which the crankshaft 16 extends.

As illustrated in FIG. 6, the blow-by gas intake part 205 has an intake port 253*a* which introduces the blow-by gas B from the interior of the crankcase 13, and an intake passageway 254*a* which allows the intake port 253*a* and the crank inside passageway 241 to communicate with each other. Here, the intake passageway 254*a* and the crank inside passageway 241 are connected to each other by the first communication passageway 42*d*.

As illustrated in FIG. 6, the protruding portion 253 has the oil penetration inhibiting portion 255 that prevents the oil O from penetrating into the intake passageway 254*a* from the intake port 253*a*. Specifically, the oil penetration inhibiting portion 255 has a flange portion 255*a* that protrudes outward in a radial direction from the circumferential edge portion of the intake port 253*a*. The flange portion 255*a* is disposed at the tip end portion (end portion at the X2 side) of the protruding portion 253. The flange portion 255*a* has a thickness in the direction (X direction) in which the protruding portion 253 protrudes. The flange portion 255*a* may be formed to be thin. In addition, a gap is formed between the flange portion 255*a* and the inner surface portion 13*c* of the crankcase 13. Further, the other configurations of the second embodiment are identical to those of the first embodiment.

Effect of Second Embodiment

The following effects may be obtained in the second embodiment.

In the second embodiment, the protruding portion 253 has the oil penetration inhibiting portion 255 that prevents the oil O from penetrating into the intake passageway 254*a* from the intake port 253*a*. Therefore, the oil penetration inhibiting portion 255 may inhibit the oil O attached to the protruding portion 253 from penetrating into the intake passageway 254*a* from the intake port 253*a*. As a result, it is possible to further inhibit the oil O from penetrating into the blow-by gas passageway 204.

In addition, in the second embodiment, the oil penetration inhibiting portion 255 has the flange portion 255*a* that protrudes outward in the radial direction from the circumferential edge portion of the intake port 253*a*. Therefore, the oil O traveling along the surface of the protruding portion 253 may flow downward along the flange portion 255*a* before the oil O attached to the protruding portion 253 reaches the intake port 253*a* while traveling along the surface of the protruding portion 253. As a result, it is possible to further inhibit the penetration of the oil O into the blow-by gas passageway 204 by means of the simple configuration in which the flange portion 255*a* is formed on the protruding portion 253. Further, the other effects of the second embodiment are identical to those of the first embodiment.

<Modification>

It should be considered that all of the embodiments disclosed herein are illustrative in all aspects, but not limitative. The scope of this disclosure is defined by the claims instead of the description of the embodiments and includes all variations (modifications) within the meaning and scope equivalent to the claims.

For example, in the first and second embodiments, the multiple blow-by gas intake parts 5 (205) are disposed on the inner surface portion 13*c* of the crankcase 13, but this disclosure is not limited thereto. In this disclosure, a single blow-by gas intake part may be provided. Further, in the case in which the single blow-by gas intake part is provided, the blow-by gas intake part may be disposed at a side opposite to the side at which the timing chain is disposed in the direction in which the crankshaft extends. Therefore, it is possible to make the oil hardly attached to the timing chain to be attached to the blow-by gas intake part even if the oil is scattered by the rotation of the timing chain.

For example, in the first and second embodiments, the blow-by gas intake parts 5 (205) are disposed at multiple points between the cylinders 12*a*, but this disclosure is not limited thereto. In this disclosure, the blow-by gas intake parts may be disposed at a single point between the cylinders 12*a*.

In the first and second embodiments, each intake port 53*a* (253*a*) is opened at the side opposite to the TCC 14 in the direction in which the crankshaft 16 extends, but this disclosure is not limited thereto. In this disclosure, the intake port may be opened at the TCC side in the direction in which the crankshaft extends.

In the first and second embodiments, each blow-by gas intake part 5 (205) is disposed at a position P1 below the crank journal 16*a* of the crankshaft 16, but this disclosure is not limited thereto. In this disclosure, the blow-by gas intake part may be disposed at a position above a crank journal of the crankshaft.

In the first and second embodiments, the connecting passageway 42 (242) of the blow-by gas passageway 4 (204) is formed in the TCC 14, but this disclosure is not limited thereto. For example, the connecting passageway may be formed in the cylinder block.

In the first and second embodiments, the oil separator 43 is disposed in the connecting passageway 42 (242) of the blow-by gas passageway 4 (204), but this disclosure is not limited thereto. For example, the oil separator may not be disposed in the connecting passageway.

In addition to the configurations of the first and second embodiments, a wire net with coarse meshes may be provided in the intake port 53*a* (253*a*) of each of the blow-by gas intake parts 5 (205). Therefore, it is possible to further inhibit the penetration of the scattering oil having a large particle diameter from the intake port 53*a* of each of the blow-by gas intake parts 5.

Figure 7A:
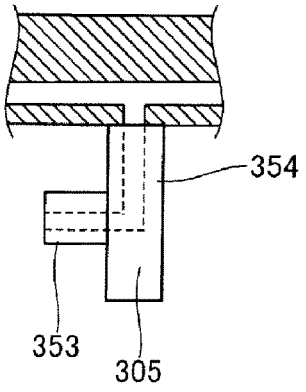
FIG. 7A is a cross-sectional view illustrating a modified example of a protruding portion of a blow-by gas intake part.

In the first embodiment, each blow-by gas intake part 5 has a shape in which the protruding portion 53 protrudes from the tip end portion of the connecting portion 54 at one side in the direction in which the crankshaft 16 extends, but the present disclosure is not limited thereto. In the embodiment disclosed here, as illustrated in FIG. 7A, the blow-by gas may have a shape in which a protruding portion 353 protrudes from the central portion of a connecting portion 354 at one side in the direction in which the crankshaft 16 extends.

Figure 7B:
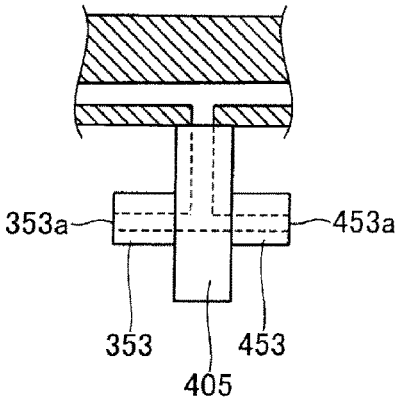
FIG. 7B is a cross-sectional view illustrating a modified example of the protruding portion of the blow-by gas intake part.
Figure 7C:
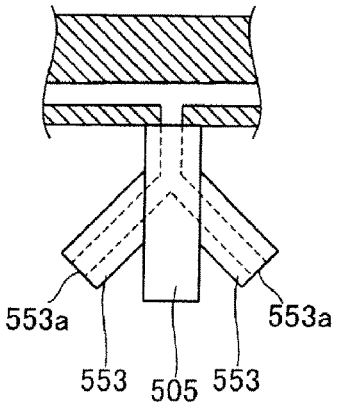
FIG. 7C is a cross-sectional view illustrating a modified example of the protruding portion of the blow-by gas intake part.

In the first and second embodiments, each blow-by gas intake part 5 (205) has the single protruding portion 53 (253), but the present disclosure is not limited thereto. For example, as illustrated in FIG. 7B, a blow-by gas intake part 405 may have the protruding portion 353 and a protruding portion 453 that protrude respectively in both directions in which the crankshaft 16 extends. Therefore, since the blow-by gas intake part 5 has an intake port 353*a* and an intake port 453*a*, it is possible to increase the amount of blow-by gas B to be introduced into the blow-by gas intake part 405. As a result, it is possible to inhibit the oil O from penetrating into the blow-by gas passageway 4 (204), and increase the amount of blow-by gas B to be recirculated from the crankcase 13. In addition, for example, as illustrated in FIG. 7C, a blow-by gas intake part 505 may have multiple protruding portions 553 that protrude in both directions in which the crankshaft 16 extends. Therefore, since the blow-by gas intake part 5 has multiple intake ports 553*a*, it is possible to increase the amount of blow-by gas B to be introduced into the blow-by gas intake part 505.

Figure 8:
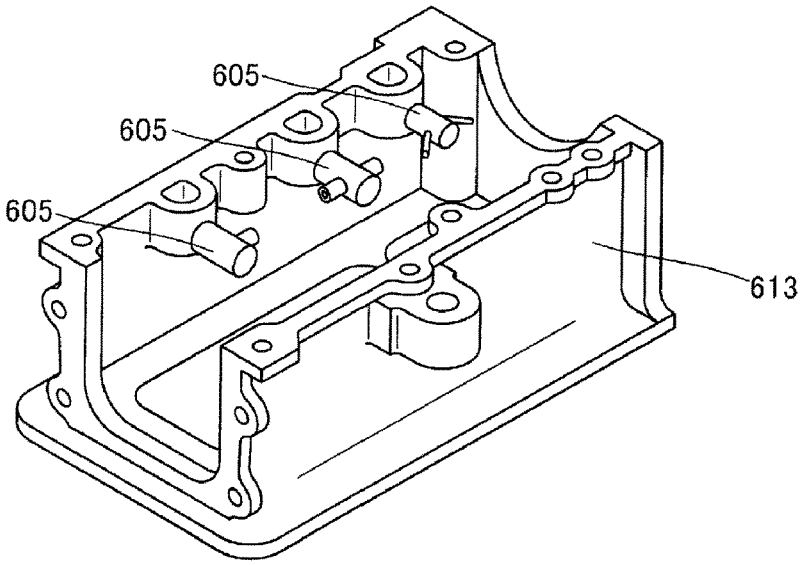
FIG. 8 is a perspective view illustrating a schematic configuration of an engine according to a modified example disclosed here.

In the first and second embodiments, all of the multiple blow-by gas intake parts 5 (205) have the same shape, but this pressure is not limited thereto. For example, as illustrated in FIG. 8, multiple blow-by gas intake parts 605 may have different shapes. In addition, for example, the multiple blow-by gas intake parts may be configured to include the protruding portion having the configuration of the first embodiment and the protruding portion having the configuration of the second embodiment.

Figure 9A:
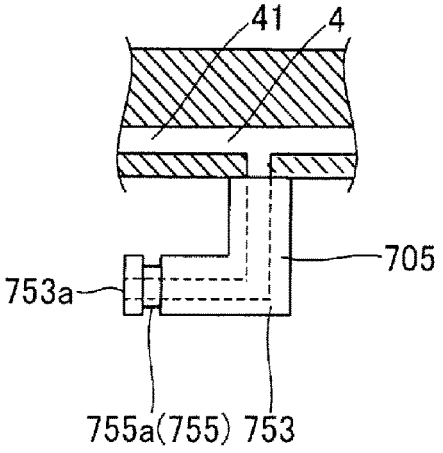
FIG. 9A is a cross-sectional view illustrating a modified example of an oil penetration inhibiting portion.

In the second embodiment, the oil penetration inhibiting portion 255 is configured by the flange portion 255*a*, but this disclosure is not limited thereto. For example, as illustrated in FIG. 9A, an oil penetration inhibiting portion 755 may be a groove portion 755*a* formed in an outer circumferential surface of a protruding portion 753. Therefore, the oil O traveling along the surface of the protruding portion 753 may flow downward along the groove portion 755*a* before the oil O attached to the protruding portion 753 reaches an intake port 753*a* while traveling along the surface of the protruding portion 753. As a result, it is possible to further inhibit the penetration of the oil O into the blow-by gas passageway 4 by the simple configuration in which the groove portion 755*a* is formed on the protruding portion 753. Further, the groove portion 755*a* may be formed over the entire circumference of the outer circumferential surface of the protruding portion 753 in the circumferential direction. Therefore, it is possible to further inhibit the oil O from penetrating into the blow-by gas passageway 4.

Figure 9B:
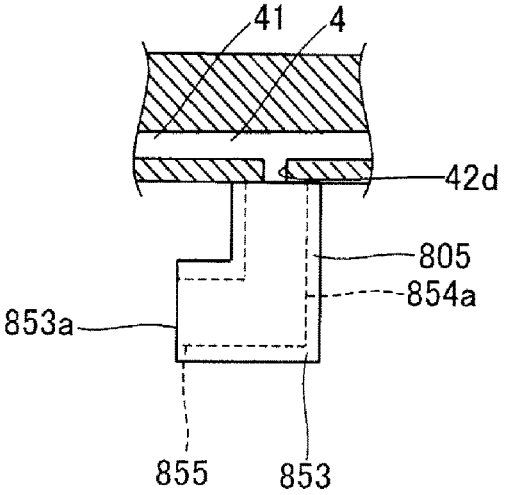
FIG. 9B is a cross-sectional view illustrating a modified example of the oil penetration inhibiting portion.

As illustrated in FIG. 9B, an oil penetration inhibiting portion 855 may be configured by setting the passageway width of an intake passageway 854*a* to be greater than the passageway width of the blow-by gas passageway 4. Here, since the passageway width of the intake passageway 854*a* is greater than the passageway width of the blow-by gas passageway 4, the flow velocity of the blow-by gas B flowing along the intake passageway 854*a* may be lower than the flow velocity of the blow-by gas B flowing along a blow-by gas passageway 804. Therefore, a flow velocity of the blow-by gas B flowing along the intake passageway 854*a* is decreased in comparison with the case in which the passageway width of the intake passageway 854*a* and the passageway width of the blow-by gas passageway 804 are equal to each other, and as a result, it is possible to decrease force for drawing the oil O into the intake passageway 854*a*. As a result, since the passageway width of the intake passageway 854*a* is greater than the passageway width of the blow-by gas passageway 4, it is possible to further inhibit the oil O from penetrating into the blow-by gas passageway 804.

An internal combustion engine according to an aspect of this disclosure includes: a cylinder that has a combustion chamber formed at an upper side thereof and accommodates a piston to be reciprocally movable; a crankcase that is provided below the cylinder and accommodates a crankshaft; and a blow-by gas passageway that recirculates blow-by gas, which leaks into the crankcase from the combustion chamber, to the combustion chamber through an intake system, in which an inner surface portion of the crankcase is provided with a blow-by gas intake part that includes an intake port into which the blow-by gas is introduced from the crankcase and an intake passageway which allows the intake port and the blow-by gas passageway to communicate with each other, and the blow-by gas intake part includes a protruding portion that protrudes in a direction in which the crankshaft extends, and the intake port opened in the protruding direction is formed at a tip end portion of the protruding portion.

In the internal combustion engine according to the aspect of this disclosure, as described above, the intake port of the protruding portion, which takes the blow-by gas into the blow-by gas passageway, is opened in the direction in which the protruding portion protrudes in the direction of the crankshaft. Therefore, the opening of the intake port can be provided at the position that does not face the oil which is scattered by a rotation of the crankshaft in a direction orthogonal to the direction in which the crankshaft extends, and consequently, it is possible to make the oil hardly attached to the intake port formed at the tip end portion of the protruding portion. As a result, the oil is hardly drawn into the intake passageway from the intake port, and as a result, it is possible to inhibit the oil from penetrating into the blow-by gas passageway.

In the internal combustion engine according to the aspect, it is preferable that the protruding portion is disposed at at least one point between a plurality of the cylinders.

Here, the crankshaft includes crankpins which are disposed at positions corresponding to the plurality of the cylinders, and crank journals which are disposed between the multiple cylinders, respectively. Since the protruding portions are disposed between the multiple cylinders as described above, the protruding portions may be disposed at the positions facing the crank journals of the crankshaft. Therefore, the oil, which is scattered from the crankpins which are disposed at the positions eccentric to the rotation axis of the crankshaft and pass through the positions adjacent to the inner surface portion of the crankcase, is hardly caught by the protruding portions, and as a result, it is possible to further inhibit the oil from penetrating into the blow-by gas passageway.

In the internal combustion engine according to the aspect, it is preferable that the protruding portion has an oil penetration inhibiting portion that prevents oil from penetrating into the intake passageway from the intake port.

With this configuration, the oil penetration inhibiting portion may inhibit the oil attached to the protruding portion from penetrating into the intake passageway from the intake port. Therefore, it is possible to further inhibit the oil from penetrating into the blow-by gas passageway.

In this case, it is preferable that the oil penetration inhibiting portion has a flange portion which protrudes outward in a radial direction from a circumferential edge portion of the intake port.

With this configuration, the oil traveling along the surface of the protruding portion may flow downward along the flange portion before the oil attached to the protruding portion reaches the intake port while traveling along the surface of the protruding portion. Therefore, it is possible to further inhibit the penetration of the oil into the blow-by gas passageway by the simple configuration in which the flange portion is formed on the protruding portion.

In the internal combustion engine in which the protruding portion has the oil penetration inhibiting portion, it is preferable that the oil penetration inhibiting portion is configured by setting a passageway width of the intake passageway to be greater than a passageway width of the blow-by gas passageway.

With this configuration, the passageway width of the intake passageway is greater than the passageway width of the blow-by gas passageway, and as a result, a flow velocity of the blow-by gas flowing along the intake passageway may be lower than a flow velocity of the blow-by gas flowing along the blow-by gas passageway. Therefore, a flow velocity of the blow-by gas flowing along the intake passageway is decreased in comparison with the case in which the passageway width of the intake passageway and the passageway width of the blow-by gas passageway are equal to each other, and as a result, it is possible to decrease force for drawing the oil into the intake passageway. As a result, since the passageway width of the intake passageway is greater than the passageway width of the blow-by gas passageway, it is possible to further inhibit the oil from penetrating into the blow-by gas passageway.

In this disclosure, the following configurations are also conceivable with respect to the internal combustion engine according to the aspect.

In the internal combustion engine in which the protruding portion has the oil penetration inhibiting portion, it is preferable that the oil penetration inhibiting portion includes a groove portion formed in an outer circumferential surface of the protruding portion.

In this case, it is preferable that the groove portion is formed over the entire circumference of the outer circumferential surface of the protruding portion in a circumferential direction.

In the internal combustion engine according to the aspect, it is preferable that the blow-by gas intake part is disposed at a side opposite to a side at which a timing chain is disposed in the direction in which the crankshaft extends.

In the internal combustion engine according to the aspect, it is preferable that the protruding portion is disposed below the crankshaft.

An internal combustion engine according to another aspect of this disclosure includes: a cylinder that has a combustion chamber formed at an upper side thereof and accommodates a piston to be reciprocally movable; a crankcase that is provided below the cylinder and accommodates a crankshaft; and a blow-by gas passageway that recirculates blow-by gas, which leaks into the crankcase from the combustion chamber, to the combustion chamber through an intake system, in which an inner surface portion of the crankcase is provided with a blow-by gas intake part that includes an intake port into which the blow-by gas is introduced from the crankcase and an intake passageway which allows the intake port and the blow-by gas passageway to communicate with each other, the blow-by gas intake part includes a protruding portion (53, 253, 353, 453, 553, 753) that protrudes in a direction in which the crankshaft extends, and the intake port opened in the protruding direction is formed at a tip end portion of the protruding portion, and the blow-by gas intake part has a plurality of protruding portions which protrude in both directions in the direction in which the crankshaft extends, and each of the plurality of protruding portions has an intake port formed at a tip end portion thereof.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. An internal combustion engine comprising:

a cylinder that has a combustion chamber formed at an upper side thereof and accommodates a piston to be reciprocally movable;

a crankcase that is provided below the cylinder and accommodates a crankshaft; and a blow-by gas passageway that recirculates blow-by gas, which leaks into the crankcase from the combustion chamber, to the combustion chamber through an intake system, wherein an inner surface portion of the crankcase is provided with a blow-by gas intake part that includes an intake port into which the blow-by gas is introduced from the crankcase and an intake passageway which allows the intake port and the blow-by gas passageway to communicate with each other, and the blow-by gas intake part includes a protruding portion that protrudes in a direction parallel to a central axis of the crankshaft, and the intake port opened in the protruding direction is formed at a tip end portion of the protruding portion.

2. The internal combustion engine according to claim 1, wherein the protruding portion is disposed at at least one point between a plurality of the cylinders.

3. The internal combustion engine according to claim 1, wherein the protruding portion has an oil penetration inhibiting portion that prevents oil from penetrating into the intake passageway from the intake port.

4. The internal combustion engine according to claim 3, wherein the oil penetration inhibiting portion has a flange portion which protrudes outward in a radial direction from a circumferential edge portion of the intake port.

5. The internal combustion engine according to claim 3, wherein the oil penetration inhibiting portion is configured by setting a passageway width of the intake passageway to be greater than a passageway width of the blow-by gas passageway.

6. The internal combustion engine according to claim 3, wherein the oil penetration inhibiting portion includes a groove portion formed in an outer circumferential surface of the protruding portion.

7. The internal combustion engine according to claim 6, wherein the groove portion is formed over the entire circumference of the outer circumferential surface of the protruding portion in a circumferential direction.

8. The internal combustion engine according to claim 1, wherein the blow-by gas intake part is disposed at a side opposite to a side at which a timing chain is disposed in the direction in which the crankshaft extends.

9. The internal combustion engine according to claim 1, wherein the protruding portion is disposed below the crankshaft.

10. An internal combustion engine comprising:

a cylinder that has a combustion chamber formed at an upper side thereof and accommodates a piston to be reciprocally movable;

a crankcase that is provided below the cylinder and accommodates a crankshaft; and a blow-by gas passageway that recirculates blow-by gas, which leaks into the crankcase from the combustion chamber, to the combustion chamber through an intake system, wherein an inner surface portion of the crankcase is provided with a blow-by gas intake part that includes an intake port into which the blow-by gas is introduced from the crankcase and an intake passageway which allows the intake port and the blow-by gas passageway to communicate with each other, the blow-by gas intake part includes a protruding portion that protrudes in a direction parallel to a central axis of the crankshaft, and the intake port opened in the protruding direction is formed at a tip end portion of the protruding portion, and the blow-by gas intake part has a plurality of protruding portions which protrude in both directions in the direction in which the crankshaft extends, and each of the plurality of protruding portions has an intake port formed at a tip end portion thereof.

11. The internal combustion engine according to claim 10, wherein the protruding portion is disposed between a plurality of the cylinders.

12. The internal combustion engine according to claim 10, wherein the protruding portion has an oil penetration inhibiting portion that prevents oil from penetrating into the intake passageway from the intake port.

13. The internal combustion engine according to claim 11, wherein the oil penetration inhibiting portion has a flange portion which protrudes outward in a radial direction from a circumferential edge portion of the intake port.

14. The internal combustion engine according to claim 11, wherein the oil penetration inhibiting portion is configured by setting a passageway width of the intake passageway to be greater than a passageway width of the blow-by gas passageway.

15. The internal combustion engine according to claim 11, wherein the oil penetration inhibiting portion includes a groove portion formed in an outer circumferential surface of the protruding portion.

16. The internal combustion engine according to claim 15, wherein the groove portion is formed over the entire circumference of the outer circumferential surface of the protruding portion in a circumferential direction.

17. The internal combustion engine according to claim 10, wherein the blow-by gas intake part is disposed at a side opposite to a side at which a timing chain is disposed in the direction in which the crankshaft extends.

18. The internal combustion engine according to claim 10, wherein the protruding portion is disposed below the crankshaft.

* * * * *